US007775730B2

(12) United States Patent
Murahashi et al.

(10) Patent No.: US 7,775,730 B2
(45) Date of Patent: Aug. 17, 2010

(54) METHOD FOR DETECTING FAILURE OF A PAPER DETECTOR IN A ROLL PAPER PRINTER, AND ROLL PAPER PRINTER HAVING CONTROL FOR DETECTING FAILURE OF A PAPER DETECTOR

(75) Inventors: Kenichi Murahashi, Matsumoto (JP); Junichi Arai, Matsumoto (JP); Toshiaki Koike, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 476 days.

(21) Appl. No.: 11/978,423

(22) Filed: Oct. 29, 2007

(65) Prior Publication Data

US 2008/0101843 A1 May 1, 2008

(30) Foreign Application Priority Data

Oct. 31, 2006 (JP) ..... 2006-295366

(51) Int. Cl.
*B41J 29/38* (2006.01)
*B41J 29/13* (2006.01)
*B41J 29/46* (2006.01)

(52) U.S. Cl. ..... 400/76; 400/613; 400/703

(58) Field of Classification Search ..... 400/703
See application file for complete search history.

(56) References Cited

U.S. PATENT DOCUMENTS 4,674,899 A * 6/1987 Kimura ..... 400/605
5,000,595 A * 3/1991 Koike et al. ..... 400/588
6,179,498 B1 1/2001 Tsukada ..... 400/582
6,629,796 B2 10/2003 Kawakami et al. ..... 400/582
2008/0003041 A1 * 1/2008 Sekino et al. ..... 400/188

FOREIGN PATENT DOCUMENTS

JP 56062476 A * 5/1981
JP 9-300750 11/1997
JP 10-059582 3/1998
JP 2002-255396 9/2002
JP 2002-264414 9/2002

* cited by examiner

*Primary Examiner*—Daniel J Colilla

(57) ABSTRACT

The roll paper printer of the subject invention has a control to detect failure of a paper detector in accordance with a method for detecting such failure. The printer 1 is constructed so that the paper transportation path is open when the cover 3 to the roll paper compartment 10 is open and includes a paper detector 40 and a control unit 30 to determine if the paper detector 40 is faulty. A failure warning is provided by a warning indicator 7(S7, 8) to indicate failure of the paper detector 40 when the cover 3 has been open continuously for at least a first set time (S6) and the output state of the paper detector 40 has not changed even once to a no-paper state within the first set time. Preferably, the printing operation of the printer 1 is disabled upon determining that the paper detector 40 is faulty to permit replacement of the paper detector. Problems attributable to paper detector failure, such as soiling the platen with ink can thus be prevented.

18 Claims, 8 Drawing Sheets

METHOD FOR DETECTING FAILURE OF A PAPER DETECTOR IN A ROLL PAPER PRINTER, AND ROLL PAPER PRINTER HAVING CONTROL FOR DETECTING FAILURE OF A PAPER DETECTOR

BACKGROUND OF THE INVENTION

1. Field of Invention

The present invention relates to a method for detecting failure of a paper detector in a roll paper printer constructed so that opening the cover to the roll paper compartment opens the paper transportation path, and to a roll paper printer having control for detecting failure of a paper detector.

2. Description of Related Art

Roll paper printers constructed so that opening the cover to the roll paper compartment also opens the paper transportation path from the roll paper compartment passed the printing position of the print head to the paper exit so that the roll paper can be easily loaded and replaced are known from the literature. See, for example, JP-A-2002-264414.

This type of roll paper printer may have a paper detector for detecting if a web of the recording paper that is delivered (pulled) from the paper roll is present in the transportation path, and a cover detector for detecting if the cover to the roll paper compartment is opened and closed and may issue an appropriate warning if there is no paper present or if the cover is open.

However, if the paper detector fails and indicates that the printing paper is present even though the paper is not present in the paper transportation path, problems such as soiling of the platen and other parts will occur. For example, if the print head is an inkjet head ink droplets will be discharged directly onto the surface of the platen, and the platen surface will be soiled with ink.

Paper presence can be detected optically (using photosensors), magnetically (using magnetic sensors), or mechanically (using microswitches), and detection errors (detector failure) can occur due to aging or due to an initial defect in the paper detector. If an optical paper detector including a photointerrupter and a detection lever is used, detection errors can result due to faulty installation of the detection lever, a fault in the photointerrupter circuit, and operating errors caused by aging of the detector lever or circuit board, for example.

Conventional roll paper printers cannot, however, detect failure of such paper detectors. As a result, the paper detector may indicate that paper is present even though there is no paper, the printing operation executes with no paper present, and the platen becomes dirty or is damaged. In addition to the faulty paper detector, it may even become necessary to replace the platen.

SUMMARY OF THE INVENTION

The method of the invention detects failure of a paper detector in a roll paper printer, and a roll paper printer according to another aspect of the invention can detect paper detector failure.

A first aspect of the invention is a failure detection method for a paper detector in a roll paper printer, the method detecting failure of a paper detector that detects if printing paper is present in the paper transportation path that passes the printing position of a roll paper printer in which the transportation path is open when the cover of the roll paper compartment is open. The method includes steps of monitoring the output state of the paper detector after the cover opens; and determining that the paper detector is faulty if the output state does not change even once to a state indicating there is no paper.

In a roll paper printer constructed so that the paper transportation path is open when the cover to the roll paper storage unit is open, the printing paper that is fed through the transportation path goes slack when the cover opens, and when the cover is open wide, the transportation path is released (open). The paper detector output should therefore indicate a no-paper state when the cover is open. Focusing on this point the invention monitors the output state of the paper detector after the cover is opened and based on the output state of the paper detector determines if the paper detector is faulty or not.

Preferably, the paper detector is determined to be faulty if when the cover open state has continued for a preset first set time or longer the output state of the paper detector has not changed even once to a no-paper state during the first set time.

When the operator opens the cover unintentionally, the cover is usually closed immediately. Therefore, if failure of the paper detector is determined based on paper detector output immediately after detecting that the cover opened, the paper detector may be falsely determined to be faulty even though the paper detector correctly detects that paper is in the transportation path. Problems with the paper detector can therefore be detected more accurately if paper detector failure is determined based on the output state of the paper detector when the cover has remained open continuously for a specified time, such as when loading or replacing the roll paper.

It generally takes approximately two seconds to reclose the cover when the cover is opened accidentally. Failure of the paper detector is therefore preferably determined after the cover has been open continuously for at least three seconds.

Further preferably, the paper detector is determined to be faulty if a preset second set time that is shorter than the first set time has passed between when the cover opens and closes and the output state of the paper detector does not change even once to a no-paper state before the cover closes. This enables detecting a faulty paper detector even when the cover is not open continuously for a long time such as when replacing the roll paper.

The second set time can be set to at least two seconds. If the second set time is two seconds there is sufficient time for the paper to separate (sag) to a position that is not detected by the paper detector when the cover is opened wide and the paper transportation path is released (open), and falsely detecting a paper detector fault can be avoided.

Yet further preferably, an appropriate warning is issued if the paper detector is determined to have failed in order to inform the operator.

Yet further preferably, the printing operation of the printer is disabled if the paper detector is determined to have failed so that printing does not continue even though there is no paper.

Another aspect of the invention is a roll paper printer that can detect failure of a paper detector (by the method described above), the roll paper printer having a roll paper storage unit formed in the printer case; a cover for opening and closing the roll paper storage unit; a transportation path formed between the printer case and the cover in the closed position for conveying (passed the printing position of the print head) a recording paper web that is delivered from a paper roll stored in the roll paper storage unit; a cover detector for detecting if the cover is open or closed; a paper detector for detecting if the recording paper is present in the transportation path; a counter for counting the elapsed time from when the cover is opened based on detection output from the cover detector; and a failure detection unit that determines the paper detector is faulty if the paper detector has not changed at least once to a no-paper state when the elapsed time exceeds a preset first set time.

In another aspect of the invention the counter stops counting the elapsed time when the cover closes based on detection output from the cover detector; and the failure detection unit determines the paper detector is faulty when counting the elapsed time stops if the paper detector has not changed at least once to a no-paper state and the elapsed time exceeds a second set time that is shorter than the first set time.

Preferably, the first set time is at least three seconds, and the second set time is at least two seconds. If the first and/or second set time can be changed, failure of the paper detector can be accurately detected according to the operating environment.

Yet further preferably, the printer also has a warning device that issues an appropriate warning when the paper detector is determined to be faulty.

Yet further preferably, the printer has a printing control unit that disables the printing operation of the print head when the paper detector is determined to be faulty. If a configuration option determining whether to disable printing is preset based on specified (prescribed) input, the operating mode that is desirable for the particular operating environment can be selectively executed.

The invention enables a roll paper printer constructed so that the paper transportation path opens when the roll paper storage unit cover opens to easily and reliably detect failure of the paper detector that detects if recording paper is present in the transportation path without adding separate parts. Failure of the paper detector can therefore be detected before printing is repeated with no paper, and problems such as increased maintenance costs due to replacing the platen can be avoided.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of a roll paper printer according to the present invention is described below with reference to the accompanying figures.

General Configuration

Figure 1:
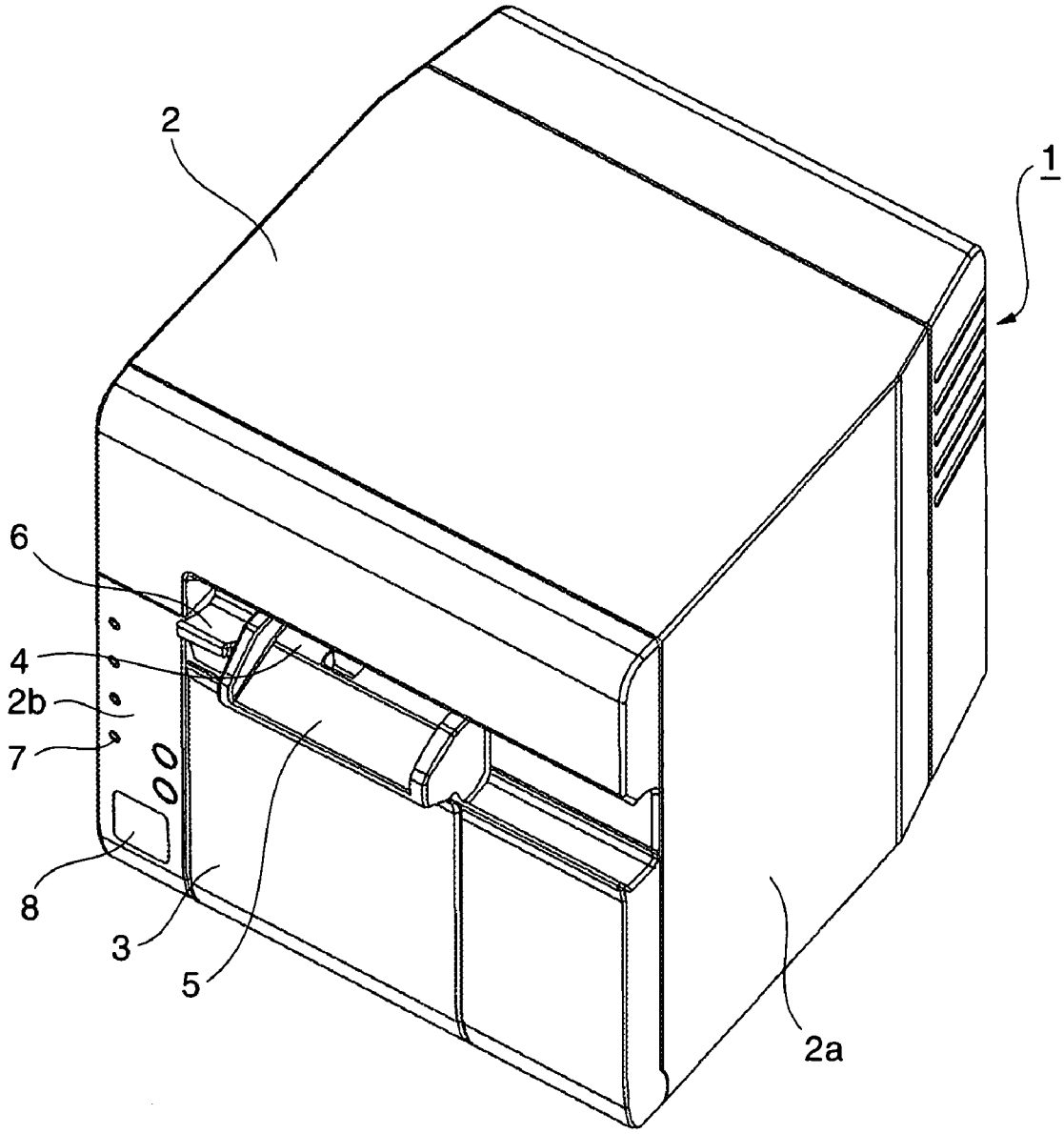
FIG. 1 is an oblique view of a roll paper printer according to the present invention.
Figure 2:
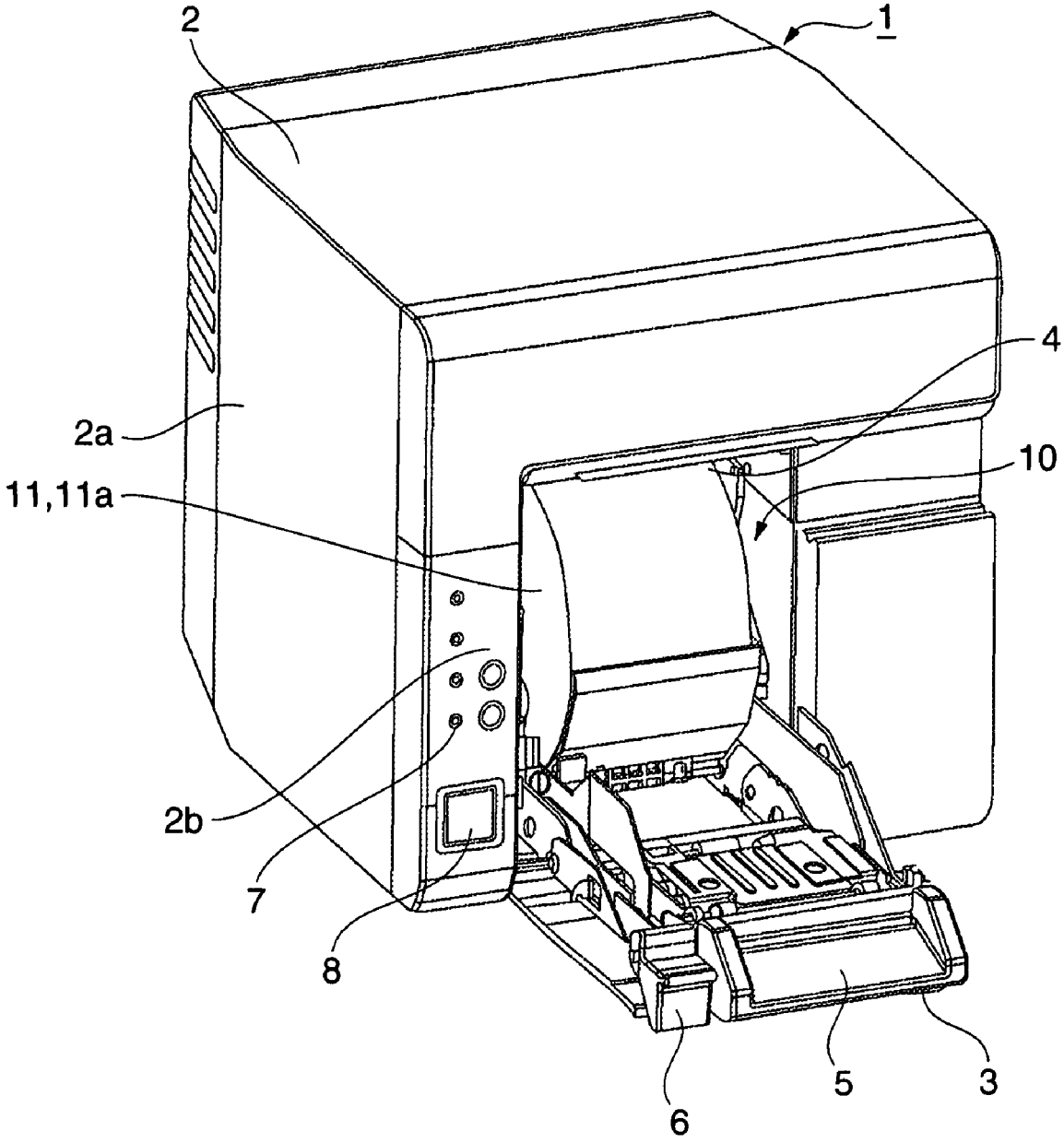
FIG. 2 is an oblique view of the roll paper printer with the cover open.

FIG. 1 is an oblique external view of an inkjet roll paper printer 1 according to the present invention, and FIG. 2 is an oblique external view showing the printer 1 with the cover 3 fully open. The printer 1 has a basically rectangular box-shaped printer body 2 (case), and a cover 3 (cover unit) that is attached to the front of the printer body 2. A paper exit 4 of a prescribed width is formed in the front of the outside case 2*a* of the printer body 2, and a discharge guide 5 projects to the front from the bottom of the paper exit 4. More specifically, the paper 11*a* is discharged from a gap between the top of the cover 3 and the printer body 2 onto the discharge guide 5.

A cover opening lever 6 is disposed beside the discharge guide 5. Operating panel 2*b* located on the left beside the cover 3 includes warning indicators 7 (warning devices), which are LEDs in this aspect of the invention, and a reset button 8.

When the cover opening lever 6 is operated, the cover 3 is unlocked, and the discharge guide 5 is pulled forward, the cover 3 pivots at its bottom end and opens forward to a substantially horizontal position as shown in FIG. 2. When the cover 3 opens the roll paper compartment 10 (roll paper storage space) formed inside the printer body 2 is open and the roll paper can be loaded and replaced from the front of the printer. The roll paper 11 is a long web of paper 11*a* of specific width wound into a roll.

Figure 3:
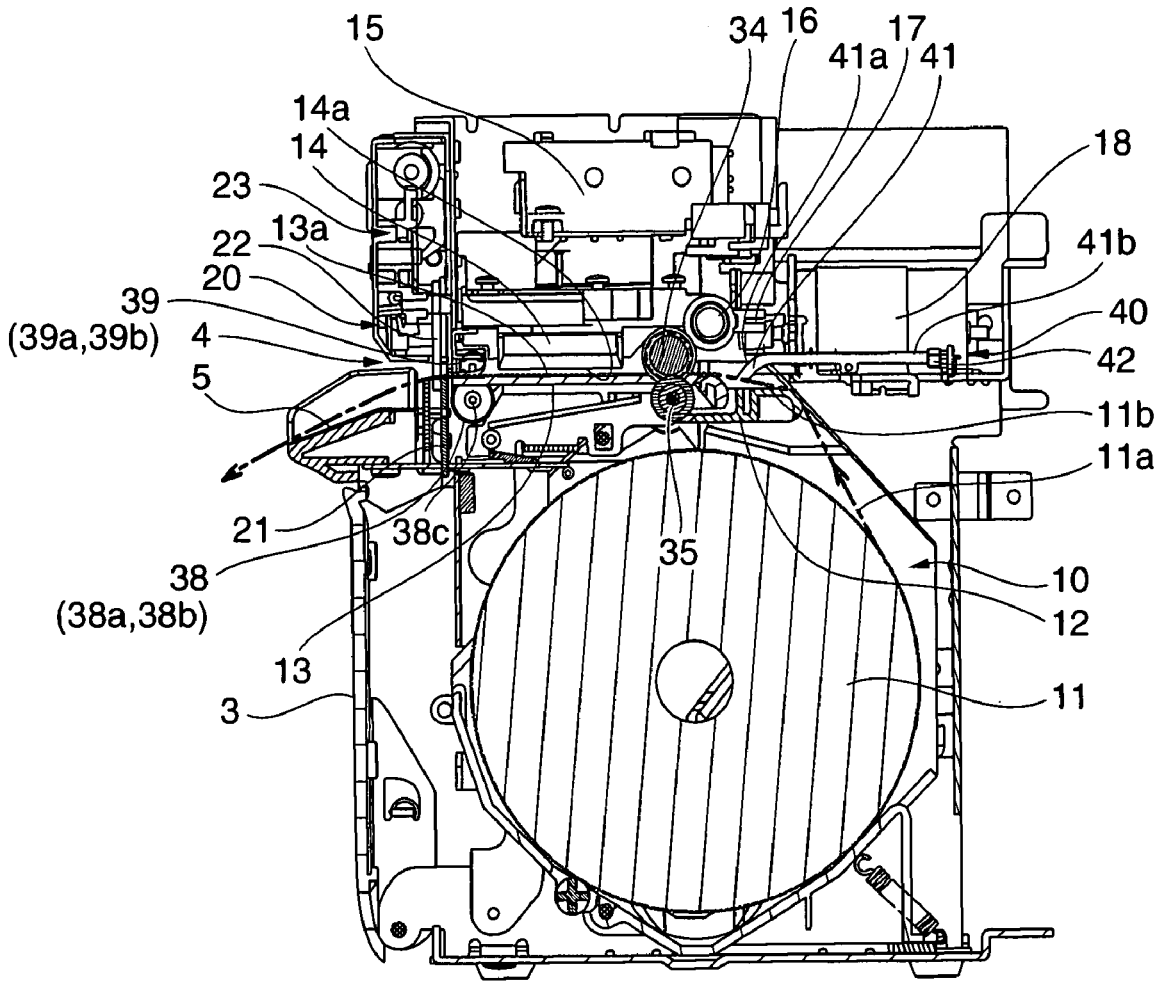
FIG. 3 is a vertical section view showing the internal construction of the roll paper printer.

FIG. 3 is a vertical section view showing the internal construction of the printer 1 with the outside case 2*a* removed. A paper guide 12 (guide member) of a prescribed width is disposed horizontally extending in the front to back direction of the printer at a position above the roll paper compartment 10 inside the printer. A platen guide 13 of a prescribed width is disposed horizontally extending in the front to back direction of the printer at a position in front of and slightly higher than the paper guide 12. An inkjet head 14 is located directly above the platen guide 13. The nozzle face 14*a* of the inkjet head 14 is opposite the top surface 13*a* of the platen guide 13 with a specific gap therebetween, and this top surface 13*a* defines the printing position. The paper guide 12 and the platen guide 13 are attached to the cover 3 and thus move in conjunction with opening and closing the cover 3.

The inkjet head 14 is mounted on a carriage 15, and the carriage 15 is supported movably side to side along a carriage guide 16 that extends horizontally widthwise to the printer. The carriage 15 is connected to a timing belt 17 that is mounted widthwise to the printer, and moves widthwise to the printer when the timing belt 17 is driven by the carriage motor 18. The inkjet head 14 mounted on the carriage 15 is driven synchronously to this movement to print on the surface of the paper 11*a* passing the printing position (13*a*).

A scissor-type paper cutter 20 is disposed near the paper exit 4 on the upstream side. The fixed blade 21 of the paper cutter 20 is disposed vertically with the cutting edge up, and the movable blade 22 is disposed vertically with the cutting edge facing down. A drive mechanism 23 causes the movable blade 22 to move bidirectionally up and down pivoting at one end across the width of the printer. When the movable blade 22 rotates down, the point of contact with the fixed blade 21 moves across the printer width and cuts the paper 11*a* located between the blades across the width of the paper.

Figure 4:
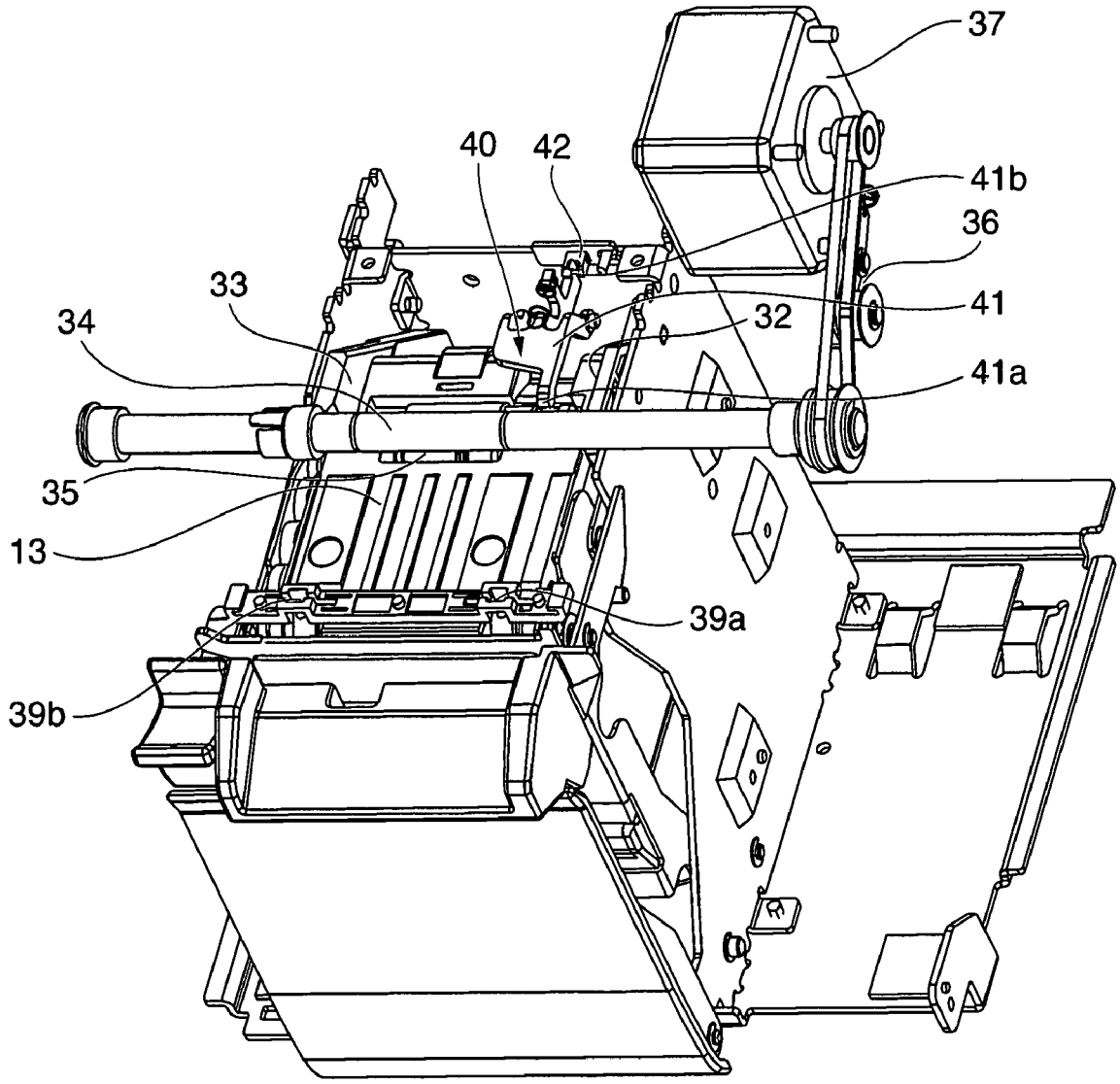
FIG. 4 is an oblique view showing the internal construction of the roll paper printer with the inkjet head and the inkjet head carriage mechanism removed.
Figure 5:
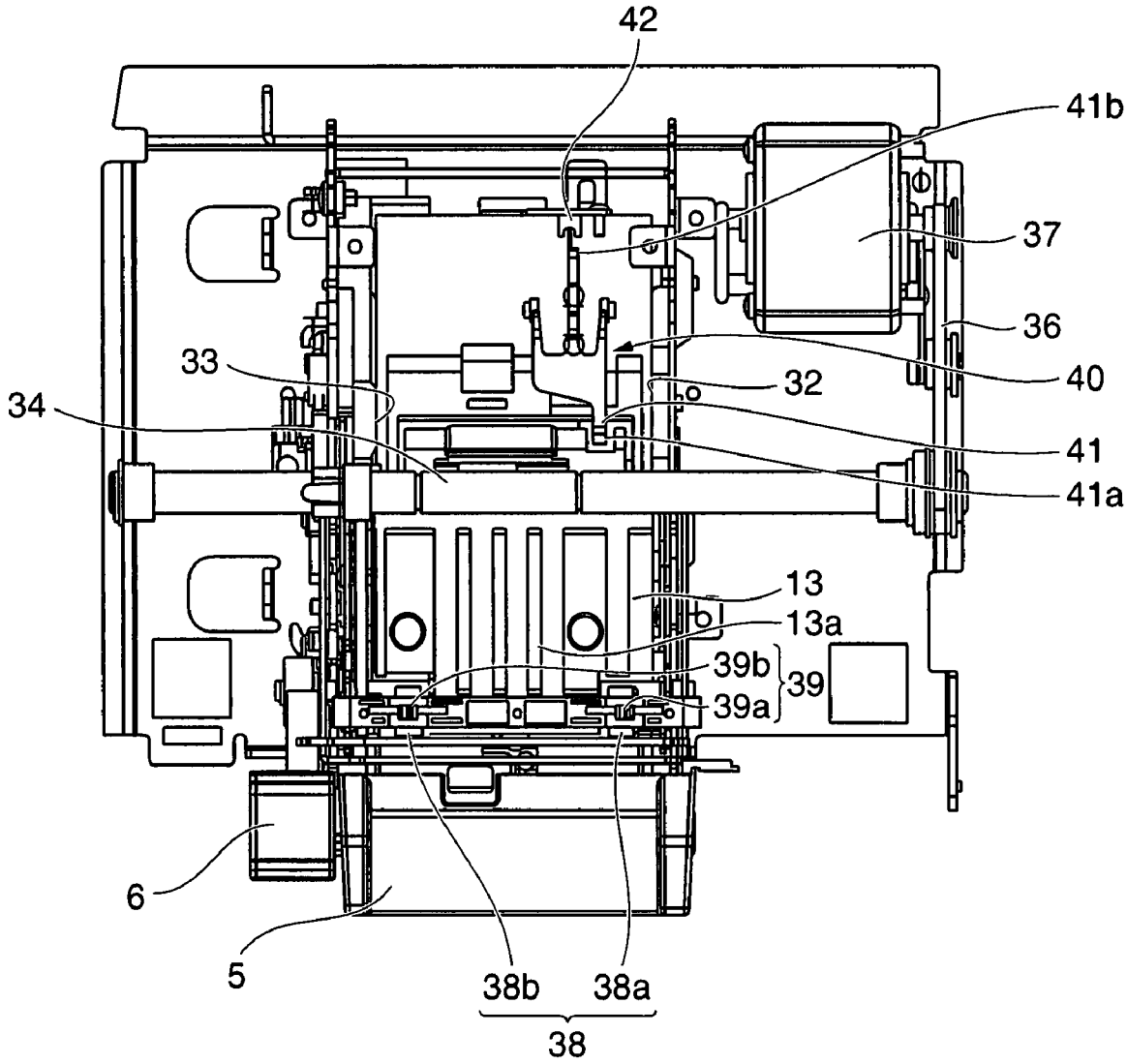
FIG. 5 is a plan view showing the internal construction of the roll paper printer with the inkjet head and the inkjet head carriage mechanism removed.

FIG. 4 and FIG. 5 are an oblique view and a plan view, respectively, showing the internal construction of the printer 1 with the inkjet head 14 and the mechanism for moving the inkjet head 14 removed. The paper transportation mechanism that conveys the paper 11*a* from the paper roll 11 passed the printing position is described next with reference to FIG. 3 to FIG. 5.

A first paper feed roller 34 is disposed horizontally widthwise to the printer between the paper guide 12 and the platen guide 13. A first paper pressure roller 35 of a prescribed width is pushed from below with a specific pressure against the first paper feed roller 34. The first paper pressure roller 35 is disposed to a position offset to the right (the side toward the guide surface 33) from the center of the width of the transportation path that is defined by the guide surfaces 32 and 33. The first paper feed roller 34 is driven by a paper feed motor 37 through an intervening belt and pulley type transfer mechanism 36.

A second paper feed roller 38 is disposed to a position at the front edge side of the platen guide 13. The second paper feed roller 38 has a left paper feed roller 38*a* and a right paper feed roller 38*b* connected coaxially by a common roller shaft 38*c*. The left paper feed roller 38*a* and the right paper feed roller 38*b* are disposed to left and right symmetrical positions. A second paper pressure roller 39 is pressed with a specific force from above to the second paper feed roller 38. The second paper pressure roller 39 has a left paper pressure roller 39*a* and a right paper pressure roller 39*b*, and the left paper pressure roller 39*a* is pressed to the left paper feed roller 38*a* and the right paper pressure roller 39*b* is pressed to the right paper feed roller 38*b*.

A paper detector 40 for detecting if the paper 11*a* that is conveyed through the transportation path from the roll paper compartment 10 passed the printing position to the paper exit 4 is present is disposed above the paper guide 12. The paper detector 40 is an optical detector that includes a detection lever 41 and a photointerrupter 42 (a transmission or reflection type sensor). The detection lever 41 is depressed at the part 11*b* (see FIG. 3) of the paper 11*a* that is conveyed over the paper guide 12 and the platen guide 13. The photointerrupter 42 detects the detection lever 41.

The detection lever 41 is supported so that it can rock vertically (substantially perpendicularly to the transportation path), and is urged by an urging member not shown so that the distal end part 41*a* of the detection lever 41 rotates downward. When paper 11*a* (roll paper 11) is set in the transportation path, the distal end part 41*a* of the detection lever 41 is touched from above by a part 11*b* of the paper so that the proximal end part 41*b* of the detection lever 41 is positioned in the detection range of the photointerrupter 42. When the paper 11*a* (roll paper 11) is removed from the transportation path, the distal end part 41*a* of the detection lever 41 rotates in the direction moving down, causing the proximal end part 41*b* to move up and leave the detection area of the photointerrupter 42. Whether paper 11*a* is present in the transportation path can therefore be detected by detecting if the proximal end part 41*b* of the detection lever 41 is positioned in the detection area of the photointerrupter 42 based on output from the photointerrupter 42.

In a printer 1 thus configured the paper 11*a* is pulled from the paper roll 11 stored in the roll paper compartment 10 and is threaded through the transportation path denoted by the bold dot-dash line in FIG. 3, while being guided by the paper guide 12 passed the top surface 13*a* (printing position) of the platen guide 13 from between the first paper feed roller 34 and the first paper pressure roller 35, to between the second paper feed roller 38 and the second paper pressure roller 39, and then between the fixed blade 21 and the movable blade 22, and finally out from the paper exit 4.

Transportation of paper 11*a* begins when the first paper feed roller 34 and the second paper feed roller 38 are driven by the paper feed motor 37. The inkjet head 14 is driven synchronously with the transportation of paper 11*a*, and prints on the surface of the paper 11*a* as the paper 11*a* passes the printing position. When printing ends transportation stops with the printed part of the paper 11*a* discharged from the paper exit 4. The paper 11*a* is cut by the paper cutter 20 and the printed portion of the paper is issued as a sales receipt, for example.

Because the platen guide 13, the first paper pressure roller 35, the second paper feed roller 38, and the fixed blade 21 are disposed to the cover 3 side, these parts (the first paper pressure roller 35, the second paper feed roller 38, and the fixed blade 21) separate from their corresponding matching parts (that is, the inkjet head 14, the first paper feed roller 34, the second paper pressure roller 39, and the movable blade 22) when the cover 3 is opened at which time the transportation path opens as shown in FIG. 2. As a result, when the cover 3 is opened, roll paper 11 is loaded in the roll paper compartment 10, a length of paper 11*a* (the leading end of the paper roll 11) extending beyond the paper exit 4 is pulled from the paper roll 11, and the cover 3 is closed, the paper 11*a* is automatically threaded through the transportation path. More specifically, the paper 11*a* is set passing from the roll paper compartment 10 passed the printing position defined by the top surface 13*a* of the platen guide 13, passed the cutting position of the paper cutter 20 (between the fixed blade 21 and the movable blade 22), and out from the paper exit 4. The paper 11*a* is guided by the paper guide 12 and held between the first paper feed roller 34 and the first paper pressure roller 35 and between the second paper feed roller 38 and the second paper pressure roller 39.

In addition, because the paper detector 40 is disposed on the printer body 2 side, the distal end part 41*a* of the detection lever 41 moves down and the proximal end part 41*b* leaves the detection area of the photointerrupter 42 when the cover 3 opens, the rollers 35 and 38 (movable paper feed mechanism unit, second paper feed mechanism unit) on the cover 3 side separate from the rollers 34, 39 (stationary paper feed mechanism unit, first paper feed mechanism unit) on the printer body 2 side, and the paper 11*a* thus goes slack. Therefore, if the paper detector 40 is not faulty, the output state of the paper detector 40 when the cover 3 is open will indicate a no-paper state.

A cover detector 45 is affixed to the printer body 2 near the cover 3 and can detect if the cover 3 is open or closed. The open or closed state of the cover 3 can be detected optically (using photosensors), magnetically (using magnetic sensors), or mechanically (using microswitches). The cover detector 45 can be configured to detect displacement of the actual cover 3 or displacement of the cover opening lever 6.

Control System

Figure 6:
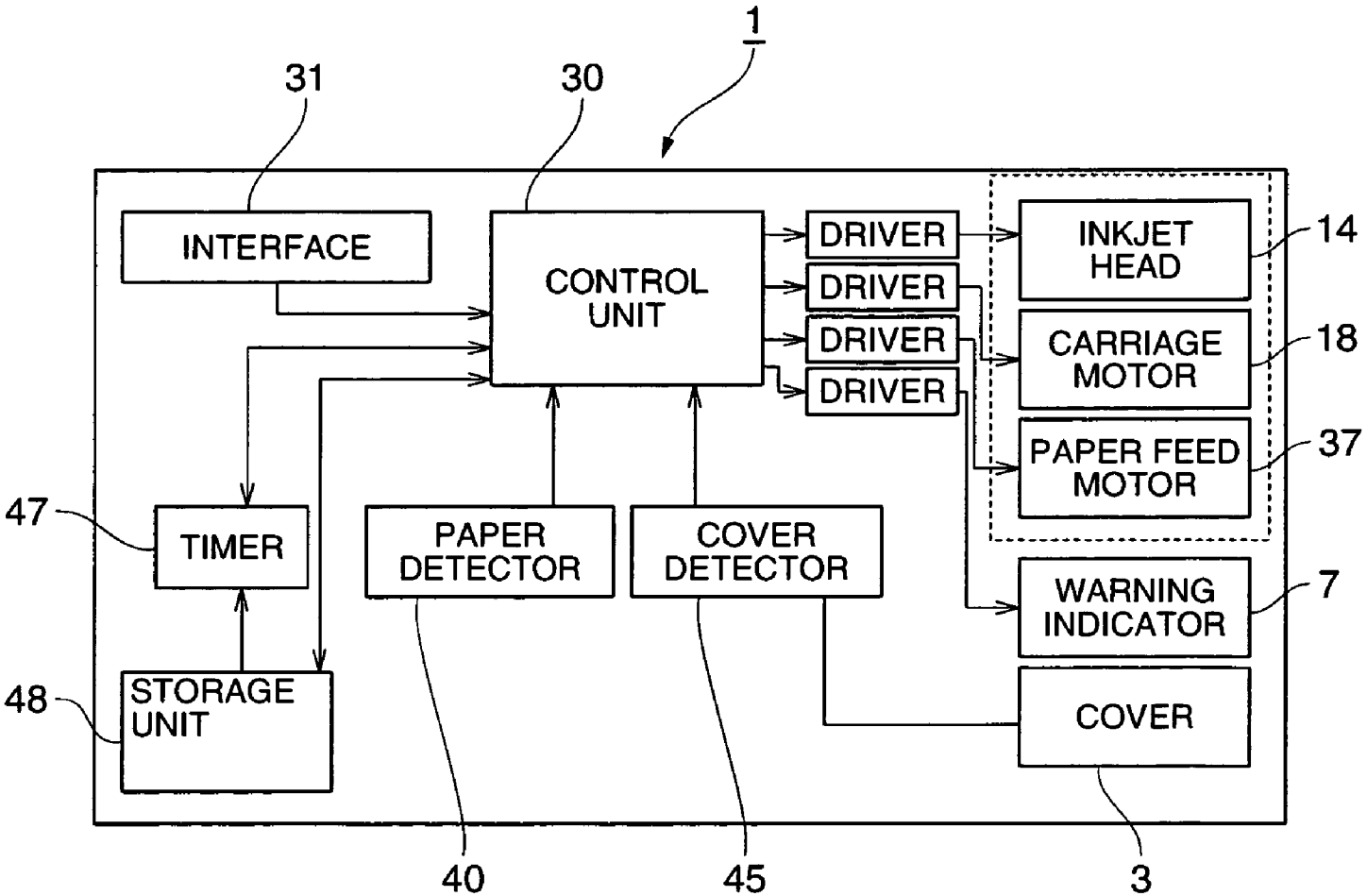
FIG. 6 is a schematic block diagram of the roll paper printer.

FIG. 6 is a schematic block diagram showing the control system of the printer 1. The control system of the printer 1 is arranged around a control unit (failure detection unit, printing control unit) 30 including a CPU, ROM, and RAM. Print data and other commands are supplied to the control unit 30 (printer 1) from a host computer, electronic cash, register (POS terminal), or other host device through an interface 31.

The paper detector 40 and the cover detector 45 are connected to the input side of the control unit 30, enabling the control unit 30 to detect if paper 11*a* is present based on signals from the paper detector 40 to detect if the cover 3 is open or closed based on signals from the cover detector 45. A timer 47 (counter) that can measure the time from when the cover 3 opens until the cover 3 closes is also connected to the input side of the control unit 30.

When the cover 3 opens and the cover 3 open state continues for a first set time or longer, the control unit 30 determines that the paper detector 40 has failed if the output state of the paper detector 40 does not change to a no-paper state at least once within this first set time.

The control unit 30 also compares the elapsed time between opening and closing the cover 3 with a second set time (<first set time), and determines that the paper detector 40 has failed if the open state of the cover 3 continues for this second set time or longer but the output state of the paper detector 40 does not change to a no-paper state at least once within this elapsed time.

The first set time and the second set time are stored in a storage unit 48 such as nonvolatile memory.

The inkjet head 14 is connected through a head driver to the output side of the control unit 30, the carriage motor 18 and the paper feed motor 37 are connected through motor drivers, and the warning indicator 7 is connected through an LED driver. If the control unit 30 determines that the paper detector 40 is faulty, the control unit 30 drives the warning indicator 7 in a particular state to issue a warning that the paper detector 40 has failed.

In this embodiment of the invention the first set time is three seconds. This first set time is determined with consideration for the minimum time required for the operator to replace the roll paper 11, and the time required to close the cover 3 again if the cover 3 is opened accidentally. The cover 3 is generally closed again within approximately two seconds when the cover 3 is accidentally opened by mistake. A longer time of three seconds is therefore set as the first set time.

The second set time in this embodiment of the invention is two seconds. Two seconds assures sufficient time for the paper 11*a* to move to a position where the paper 11*a* is not detected by the paper detector 40 once the cover 3 is open wide to the position where the transportation path is not defined, and thus avoids erroneously determining that the paper detector 40 is faulty.

Paper Detector Failure Detection

The operation whereby the printer 1 detects failure of the paper detector 40 is described next with reference to the flow charts in FIG. 7 and FIG. 8. There are two times for the printer 1 to detect a paper detector 40 failure in this embodiment of the invention.

The first time for detecting paper detector 40 failure is when the cover 3 is open for three seconds or longer. As shown in FIG. 7, when the cover detector 45 detects that the cover 3 opened, the control unit 30 sets a failure detection flag for detecting if the paper detector 40 is functioning normally or not to FALSE, the state indicating a detector failure (S1). The failure detection flag is stored in the RAM of the control unit 30, for example. The control unit 30 also resets the timer 47 and then starts the timer 47 (S2).

The control unit 30 checks the output state of the paper detector 40 at a regular sampling period (such as 100 ms) (S3, S4). If the output state of the paper detector 40 changes to the no-paper state at least once before the timer 47 counts up to the first set time of three seconds (S6), the control unit 30 determines that the paper detector 40 is normal and sets the failure detection flag to TRUE, the state indicating the detector is functioning normally (S5).

The failure detection flag remains set to FALSE if the output state of the paper detector 40 does not change to the no-paper state before the timer counts the three seconds of the first set time, that is, by the time three seconds have passed since the cover 3 was opened. In this case (S7 returns FALSE), the control unit 30 determines a fault with the paper detector 40, issues a warning by means of the warning indicator 7 (S8), and prompts the operator to replace the paper detector 40.

The second time for detecting paper detector 40 failure is when the cover 3 is closed and the time passed since the cover 3 was opened is two seconds or more. As shown in FIG. 8, when the cover detector 45 detects that the cover 3 closed, the control unit 30 stops counting (S10) by the timer 47, which started counting when the cover 3 opened (S2 in FIG. 7). If the timer 47 has not counted two seconds at this time (S11 returns No), failure detection stops without checking the state of the failure detection flag, that is, without determining if the paper detector 40 failed.

If the timer 47 has counted two seconds or more (S11 returns Yes), the control unit 30 checks the state of the failure detection flag (S12) to determine if the paper detector 40 is faulty. If the failure detection flag is TRUE, the paper detector 40 is good; if FALSE, the paper detector 40 is faulty. More specifically, the paper detector 40 is determined to be good if the output state of the paper detector 40 changes to the no-paper state at least once in the (two second or longer) period from when the cover 3 opens until it closes, but the paper detector 40 is determined to be faulty if the output state does not change to a no-paper state at least once (S4 and S5 in FIG. 7). If the control unit 30 determines that the paper detector 40 failed, the control unit 30 indicates a warning by means of the warning indicator 7 (S13) and prompts the operator to replace the paper detector 40.

Figure 7:
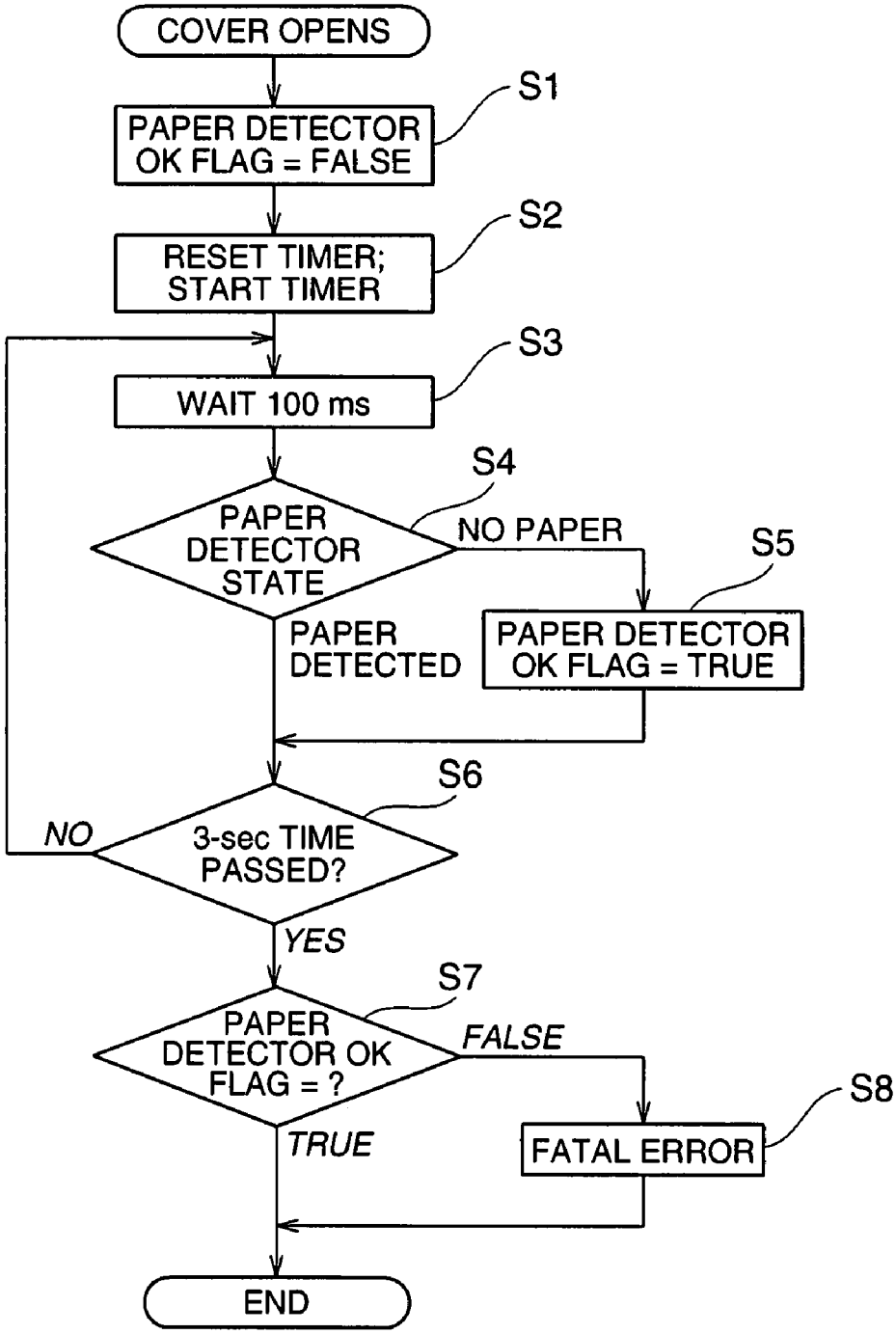
FIG. 7 is a flow chart describing a paper detector fault detection operation.
Figure 8:
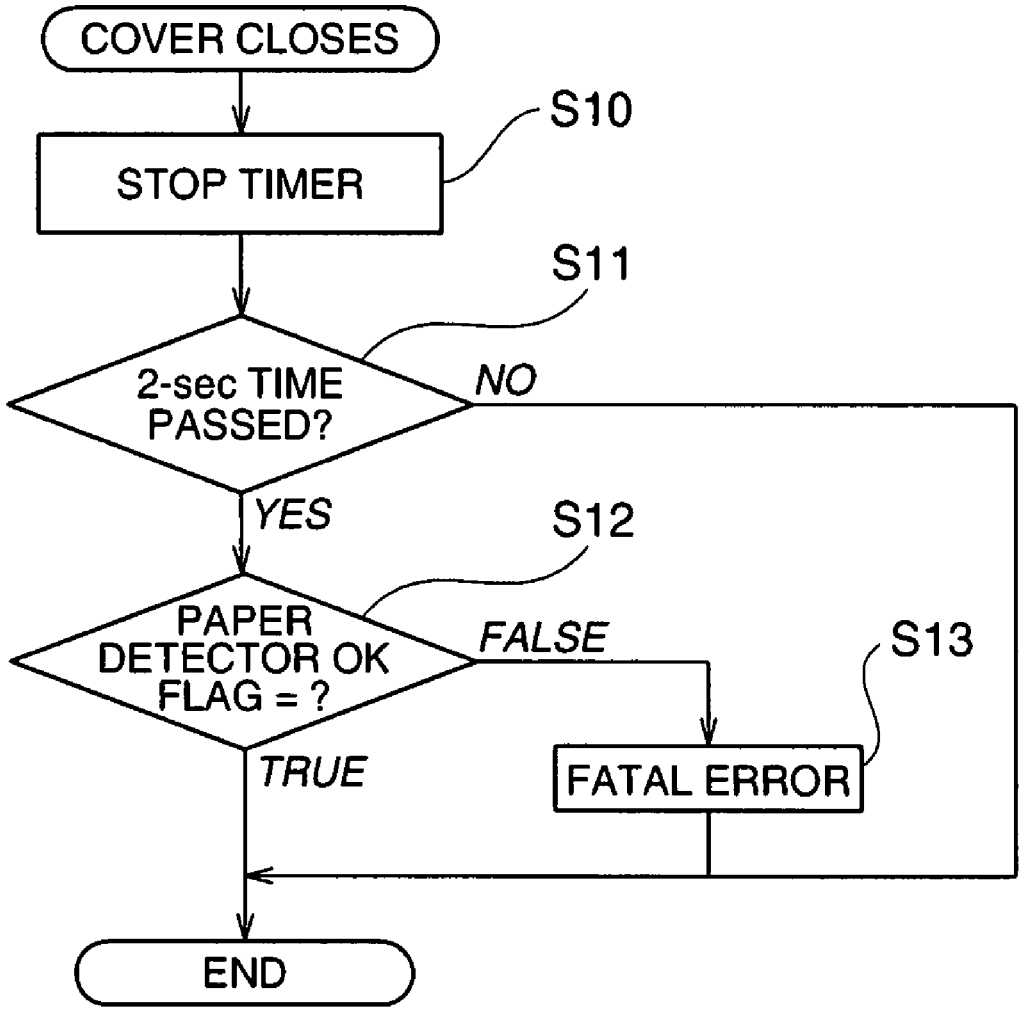
FIG. 8 is a flow chart describing a paper detector fault detection operation.

If the time between when the cover 3 opens and closes exceeds the first set time (three seconds), the failure detection operation shown in FIG. 7 has already run to determine if the paper detector 40 is faulty, and failure of the paper detector 40 may therefore be determined if the time between opening and closing the cover 3 is greater than or equal to 2 seconds and less than 3 seconds.

After a paper detector 40 fault is detected (S8, S13), the printer 1 (control unit 30) stops at least the printing operation until the paper detector 40 is fixed. Users that have multiple printers 1 can print on another printer 1 that is not faulty, but users that have only one printer 1 will be inconvenienced by the inability to print until the printer 1 is fixed or a substitute printer is made available. The paper detection operation of the paper detector 40 can therefore be temporarily disabled or the detection result can be ignored so that the printing operation of the printer 1 does not stop.

For example, a configuration option controlling whether the printing operation continues or stops after a paper detector 40 fault is detected can be stored in the storage unit 48 (nonvolatile memory) based on a command from the host device to which the printer 1 is connected or operation of an operating button on the printer 1, and the control unit 30 can be configured to select the operating mode when the paper detector 40 fails based on how this option is set. The setting of whether printing can continue or stops after a paper detector 40 fault is detected can also be controlled with DIP switches disposed to the printer 1. If printing can continue even after a paper detector 40 fault is detected, an indication prompting the operator to check that there is sufficient remaining roll paper 11 or prompting the operator to check that the roll paper 11 (paper 11*a*) is correctly loaded is preferably presented in addition to the warning indicating that the paper detector 40 is faulty for as long as the paper detector 40 is faulty.

As described above, the state of the paper detector 40 is checked each time the cover 3 is opened, including each time roll paper is loaded, in the printer 1 according to this embodiment of the invention. Repeatedly printing when there is no paper can thus be prevented, and problems such as the platen guide 13, the first paper pressure roller 35, and the second paper feed roller 38 becoming soiled with ink can be prevented.

Instead of detecting the presence of paper 11*a* immediately after the cover 3 opens, this aspect of the invention determines that the paper detector 40 is normal if a no-paper state is detected just once during the first set time or the second set time, and determines that the paper detector 40 is faulty if a no-paper state is not detected at least once during the first set time. This prevents erroneously detecting that the paper detector 40 is faulty if paper is temporarily detected to be present immediately after detecting that the cover 3 was opened when replacing the roll paper 11, for example.

This aspect of the invention drives the warning indicator 7 to indicate when a paper detector 40 fault is detected, but a LCD or other display unit can be disposed to the printer 1 and the warning can be presented on the display unit. Failure of the paper detector 40 can alternatively be reported to the host device to which the printer is connected, and the host device can display a message that the paper detector 40 is faulty on the display unit of the host device.

If a paper detector 40 fault is detected, the paper detector failure can be stored in nonvolatile storage unit 48, and the control unit 30 can check if the storage unit 48 is faulty when the printer 1 is activated (when the power turns on or the printer is reset).

The timer 47 can be a timer (counter) that outputs a time-up signal when the time (first set time and/or second set time) set by the control unit 30 is counted.

Furthermore, the first set time and/or the second set time that the control unit 30 references or the control unit 30 sets in the timer 47 can be changed according to the operating environment of the printer 1. For example, the set time can be changed based on a command from a host computer to which the printer 1 is connected, or an operating button or DIP switch for changing the set time can be disposed to the printer 1.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A method for detecting failure of a paper detector in a roll paper printer in which roll paper from a roll paper compartment is guided along a paper transportation path which is in an open state when a cover to the roll paper compartment is in an open state, the method comprising steps of:

(a) detecting if the cover is in an open or closed state;

(b) starting counting the time when step (a) detects the cover is in an open state;

(c) detecting, using the paper detector, if roll paper is present indicating a paper state or is not present indicating a no-paper state in the paper transportation path; and (d) determining that the paper detector is faulty based on the detection result from step (c);

wherein (d1) if the cover open state continues for a first set time period or longer, step (d) determines that the paper detector is faulty if the paper detector has not detected a change in state to a no-paper state within the first set time period.

2. The method of claim 1, wherein:

(d2) if when the cover is detected as being closed state in step (a) after being detected as open state the elapsed time counted in step (b) is greater than or equal to a second set time period that is shorter than the first set time period, step (d) determines that the paper detector is faulty if the paper detector has not detected a change in state to a no-paper state within the elapsed time.

3. The method of claim 2, wherein step (d2) determines the paper detector to be faulty when the elapsed time is greater than or equal to the second set time and less than the first set time.

4. The method of claim 1, further comprising a step of:

(e) reporting a paper detector failure when step (d) determines the paper detector is faulty.

5. The method of claim 1, further comprising a step of:

(f) disabling the printing operation of the printer if step (d) determines the paper detector is faulty.

6. The method of claim 5, wherein step (f) comprises steps of:

(f1) setting based on specified input whether or not to disable the printing operation of the printer when the paper detector is faulty; and (f2) selecting whether or not to disable the printing operation of the printer based on the setting configured in step (f1) when step (d) determines the paper detector is faulty.

7. The method of claim 1, further comprising a step of:

(g) changing the first set time based on specified input.

8. The method of claim 2, further comprising a step of:

(h) changing the second set time based on specified input.

9. A roll paper printer that has a case with a storage space for roll paper and a cover for opening and closing part of the roll paper storage space, enables pulling the end of roll paper inside the storage space out from a gap between the case and the free end side of the cover, comprises:

a cover detector that detects if the cover is open or closed;

a counter that counts the time elapsed from when the cover detector detects the cover as being open;

a paper feed mechanism that includes a first paper feed mechanism unit that is disposed on the case side, and a second paper feed mechanism unit that is disposed on the cover side, and can transport the roll paper that is held between the first and second paper feed mechanism units when the cover is closed;

a guide member that is disposed to the cover for guiding the roll paper when the cover is closed;

a paper detector that detects if the roll paper is present or is not present in a given part of a transportation path from the guide member to the gap; and a control unit that determines if the paper detector is faulty or not;

wherein when the counter has counted to a first set time, the control unit determines that the paper detector is faulty if the paper detector did not detect that the roll paper is not present in the transportation path within the first set time.

10. The printer of claim 9, wherein:

if when the cover closes the elapsed time counted by the counter is greater than or equal to a second set time that is shorter than the first set time, the control unit determines that the paper detector is faulty if the paper detector did not detect that the roll paper is not present in the transportation path within the elapsed time.

11. The printer of claim 10, wherein the control unit determines if the paper detector is normal or is faulty when the elapsed time is greater than or equal to the second set time and less than the first set time.

12. The printer of claim 9, further comprises a warning device that reports failure of the paper detector.

13. The printer of claim 9, wherein the control unit disables the printing operation of the print head if the paper detector is determined to be faulty.

14. The printer of claim 9, wherein the control unit selects whether or not to disable the printing operation of the print head based on a setting that is preset based on specified input, and determines whether or not to disable the printing operation when the paper detector is determined to be faulty.

15. The printer of claim 9, wherein:

the first set time is stored in a storage unit; and the first set time can be changed based on specified input.

16. The printer of claim 10, wherein:

the second set time is stored in a storage unit; and the second set time can be changed based on specified input.

17. A method for detecting failure of a paper detector in a roll paper printer in which roll paper is passed along a paper transportation path that passes the printing position of the printer, the transportation path being open when a cover of a roll paper compartment is open, the method comprising steps of:

monitoring the output state of the paper detector after the cover opens;

determining that the paper detector has failed if the output state of the paper detector does not change to a no-paper state even once;

generating an appropriate warning if the paper detector is determined to have failed; and disabling the printing operation of the printer if the paper detector is determined to have failed, wherein:

the paper detector is determined to be faulty if (i) when the cover open state has continued for a preset first set time or longer the output state of the paper detector has not changed even once to a no-paper state during the first set time and if (ii) a preset second set time that is shorter than the first set time has passed between when the cover opens and closes and the output state of the paper detector does not change even once to a no-paper state before the cover closes.

18. A roll paper printer comprising:

a printer case;

a roll paper storage unit formed in the printer case;

a cover for the roll paper storage unit which may be open or closed;

a transportation path formed between the printer case and the cover in the closed position for conveying passed the printing position of the print head a recording paper web that is delivered from a paper roll stored in the roll paper storage unit;

a cover detector for detecting if the cover is open or closed;

a paper detector for detecting whether the recording paper is present in the transportation path indicating a paper state or is not present indicating a no-paper state;

a counter for counting the elapsed time from when the cover is detected as being open to when the cover is detected as being close;

a warning device that issues an appropriate warning when the paper detector is determined to be faulty;

a printing control unit that disables the printing operation of the print head when the paper detector is determined to be faulty; and a failure detection unit that determines the paper detector is faulty in response to (i) if the paper detector has not detected a change at least once to the no-paper state when the elapsed time exceeds a preset first set time and (ii) if the paper detector has not detected a change at least once to the no-paper state and the elapsed time exceeds a second set time that is shorter than the first set time when counting of the elapsed time has stopped.

* * * * *